US005117994A

United States Patent [19]

Leblanc et al.

[11] Patent Number: 5,117,994

[45] Date of Patent: Jun. 2, 1992

[54] VARIABLE-FLOW FEEDER

[75] Inventors: Jean-François Leblanc, Voiron; Claude Boiteau, Orgeval, both of France

[73] Assignee: Laboratoires Polive, Courbevoie, France

[21] Appl. No.: 582,904

[22] PCT Filed: Feb. 8, 1990

[86] PCT No.: PCT/FR90/00123

§ 371 Date: Oct. 9, 1990

§ 102(e) Date: Oct. 9, 1990

[87] PCT Pub. No.: WO90/09161

PCT Pub. Date: Aug. 23, 1990

[30] Foreign Application Priority Data

Feb. 8, 1989 [FR] France ..... 89 01611

[51] Int. Cl.[5] ..... A61J 11/00

[52] U.S. Cl. ..... 215/11.1

[58] Field of Search ..... 215/11.1-11.6

[56] References Cited

U.S. PATENT DOCUMENTS

| | | | |
|---|---|---|---|
| 2,063,424 | 12/1936 | Ferguson | 215/11.1 |
| 2,805,663 | 9/1957 | Robinson et al. | 215/11.1 |
| 3,139,064 | 6/1964 | Harle | 215/11.1 X |
| 3,200,860 | 8/1965 | Barton et al. | 215/11.1 X |
| 3,650,271 | 3/1972 | Pelli | 215/11.1 |

FOREIGN PATENT DOCUMENTS

| | | | |
|---|---|---|---|
| 2052206 | 4/1971 | France . | |
| 3826 | 8/1891 | Switzerland | 215/11.1 |
| 2131301 | 6/1984 | United Kingdom | 215/11.1 |

*Primary Examiner*—Sue A. Weaver
*Attorney, Agent, or Firm*—Breiner & Breiner

[57] ABSTRACT

The variable-flow feeder (1) of the invention is meant to be fitted in particular onto a milk bottle and comprises at the end of its nipple (2) a slit (3) with two arms (3*a*, 3*b*) subtending between them an angle, and is characterized in that the angle subtended by the two arms of the slit (3) is an obtuse angle Γ between 165° and 95° of which the vertex lies on the feeder axis, in that the lengths $l_1$ and $l_2$ ($l_1 > l_2$) of the slit arms form such a ratio $l_1/l_2$ that it falls between a value of 1 and δ, the value of δ increasing from 1 to 10, preferably from 1 to 4.5, when the angle Γ decreases from 165° to 95°, said arms of the slit (3) being determined by cutting lines which do not remove material and issuing at their non-adjacent ends into a hole (4*b*, 4*c*) of small cross-section.

6 Claims, 3 Drawing Sheets

VARIABLE-FLOW FEEDER

Figure 1:
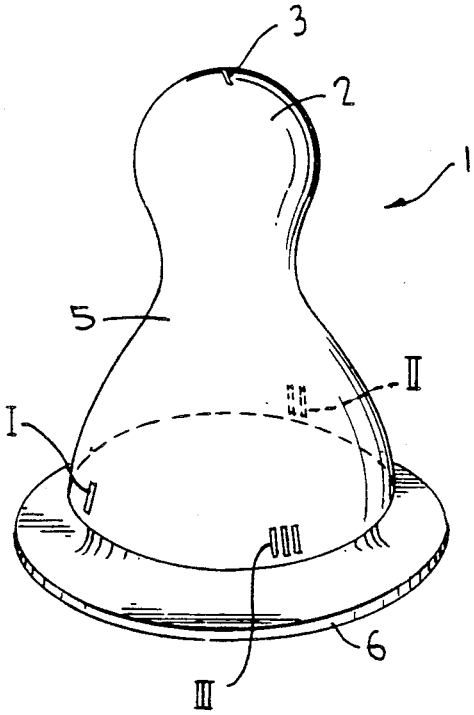

The present invention concerns a variable-flow feeder to be fitted on a bottle, in particular a milk bottle, and comprising at its end an orifice to pass the food to the infant, said orifice consisting of a slit with two arms subtending an angle between them.

The known feeders consist of a ring affixed to the milk bottle, of a body, and of the nipple proper subject to the infant's suction. It has already been suggested to provide one or more slits at the top of the nipple. It is known from French Patent No. 2,052,206 to insert a slit, whether rectilinear or otherwise, which comprises at least at one of its ends a perforation in the feeder wall. Again it is known from the U.S. Pat. No. 2,805,663 that the slit may be V-shaped, the angle subtended by the arms of the V being about 60°.

The feeder nipple may be convex, essentially spherical, at its end, in manner known per se; in that case the slit will be present in this convex end. French Patent No. 2,417,978 suggests introducing this feeding slit in a curved, concave surface, also in an essentially plane surface at the end of the nipple. When the surface is concave, the slit will be at the bottom of the cavity.

Moreover, it is common practice to position reference marks on the feeder body that assume specific positions relative to the slit(s) so as to control the slit position relative to the median plane of the child's head by rotating the milk bottle about its axis. The purpose of this control is to ensure flow regulation from the feeder through a more or less opened slit during the lip sucking motions of the infant. Conventionally there are three reference marks so positioned that mark I corresponds to minimum flow from the milk bottle, mark III will be the maximum flow, and mark II an intermediate flow; as regards a feeder with a straight slit, the reference marks I and III are positioned at a 90° distance on the feeder periphery and the reference mark II is located on the feeder in the dihedral bisecting plane defined by the nipple axis and the marks I and III on the side farthest away from these marks I and III.

As regards the milk bottles used so far, the change of its flow between its different positions has been unsatisfactory. Illustratively as regards the milk bottle with the V-shaped slit described in U.S. Pat. No. 2,805,663, the milk-bottle flow is practically the same regardless of bottle position; the user, therefore, must change the feeder if desiring to change the flow. With respect to the slit described in French Patent No. A 2,052,206, there are different flows for the positions I and III, however the flow for the position II does not significantly differ from that for position I; in these circumstances, the user passes directly from position I to position III and does not use position II (see FIG. 4).

Accordingly, a feeder is desired which offers as linear as possible a progression relative to each of the positions I, II and III, so that with one feeder, the flow may be changed if called for during the feeding; moreover, it is desired that the difference between the maximum and minimum flows be sufficient to make use of the same feeder for different foods and for different infants.

The present invention concerns a variable-flow feeder allowing to solve this problem.

The object of the present invention is a variable-flow feeder to be fitted in particular on a milk bottle and comprising at the end of its nipple a slit with two arms subtending between them an angle, said feeder being characterized in that the angle between the two slit arms is an obtuse angle F between 165° and 95° of which the vertex lies on the feeder axis, in that the slot arms are $l_1$ and $l_2$ long ($l_1 > l_2$) such that the ratio $l_1/l_2$ shall be between 1 and $\delta$, the value of $\delta$ increasing from 1 to 10, preferably from 1 to 4.5 when the value of $\Gamma$ decreases from 165° to 95°, said slit arms consisting of cutting lines which do not remove material and issuing at their non-adjacent ends into a hole of small cross-section.

Preferably the slit shall also comprise at its angular vertex a hole of small cross-section; the end of the feeder nipple is convex.

Preferably the slit arms shall be from 0.4 to 4 mm long. The holes can be circular and preferably their diameters shall be between 0.15 and 0.25 mm.

The squeezing of the feeder nipple when the infant is being fed takes place in the median plane of the infant's head. The feeder reference mark shall be that in which the position I will be in said median plane, the longest slit arm being in the plane passing thorough the reference mark III; the feeder position relative to this reference position is angularly given by an angle $\theta$. Tests have shown that when the angular $\Gamma$ is near 180°, the flow varies little near I ($\theta = 0°$ or 180°) as the milk bottle is turned, that is when the curve of flow as a function of $\theta$ is flat in the vicinity of the position I. When the angle $\Gamma$ is 165°, this flat segment practically has vanished and the flow in the position II is practically near the average of the flows for the positions I and III.

Also, when the angle $\Gamma$ further decreases, the maximum flow decreases and the minimum flow increases; when $\Gamma$ is 90°, which is the case for the British Patent No. 2,066,795, the difference between maximum and minimum flows is disadvantageously quite low.

When an angular slit subtends an angle $\Gamma$ of the invention, the feeder flow varies essentially linearly as the feeder is rotated in either direction from a value of $\theta$ of 0°, 45° or 90° (feeder position at minimum flow I, intermediate flow II, or maximum flow III), while substantial flow difference is retained between its minimum and maximum. In that case the maximum flow shall be sufficient for using otherwise milk bottle for pap or vegetable purees.

It must be borne in mind, moreover, that with the angular bit of the invention and when the feeder is not squeezed, the feeder flow will be negligible.

The description below of a milk-bottle feeder of the invention is provided in illustrative and non-limiting manner in relation tot he attached drawing and shall elucidate the invention.

Figure 3:
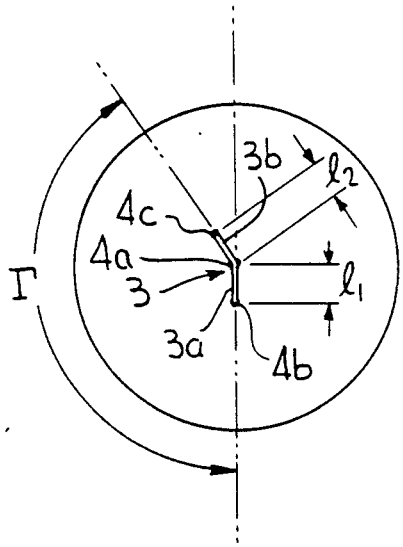
Figure 2:
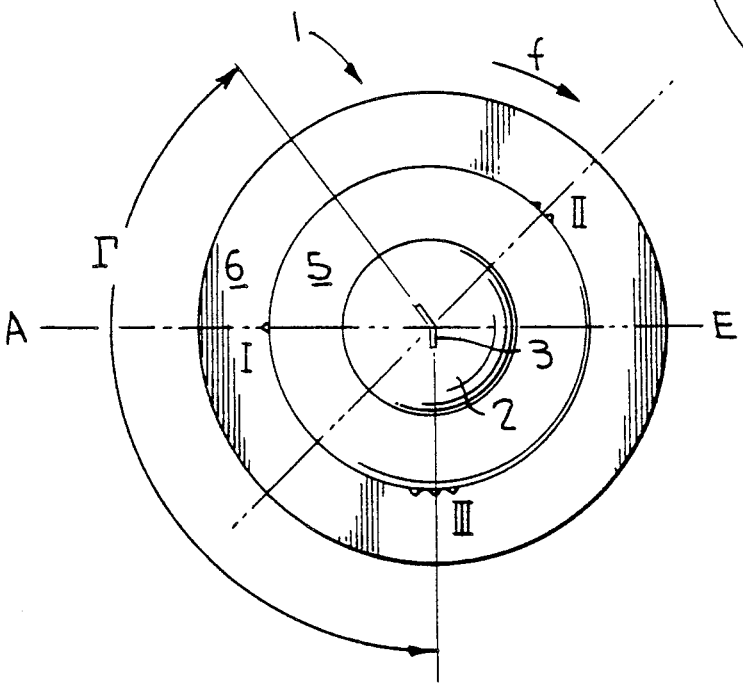

The drawing consists of:

FIG. 1, a perspective of a feeder of the invention;

FIG. 2, a view from below of the feeder of FIG. 1;

FIG. 3, an enlargement of the nipple of FIG. 2;

FIGS. 4 through 11, are curves of the feeder flow as a function of the angle of rotation $\theta$ of the feeder relative to the above-defined reference position.

In FIG. 1, the feeder of the invention is denoted by 1; this feeder 1 comprises an axis of symmetry, a nipple 2, a more or less bell-shaped body 5, and a flange 6 for fastening to the milk bottle.

The end surface of the nipple 2 is convex in the shape of a spherical cap; it comprises a slit 3 introduced without loss of material and with two arms 3*a* and 3*b* subtending between them an angle $\Gamma$, with the complementary angle being denoted by $\alpha$. The angle vertex is located on the feeder axis. The slit 3 comprises three circular holes 4*a*, 4*b*, 4*c*; the hole 4*a* is located at the top of the slit and its axis is the same as that of the feeder; the holes 4b and 4c are present at the opposite ends of the arms 3a and 3b, respectively, of the angular slit. The lengths of the arms 3a and 3b, respectively, are $l_1$ and $l_2$ ($l_1 > l_2$).

Three reference marks I, II, and III are present at the lower part of the feeder body 5. The reference marks I and II are in perpendicular planes; the reference mark III is in the plane of the arm 3a on the side of the hole 4b; the reference mark I is inside the obtuse angle Γ subtended by the two slit arms. The reference mark II is 135° away from the reference marks I and III. When the reference mark I is moved below the nose of the infant about to use the feeder, suction takes place without the slit 3 opening widely, that is, there will be the least feeder flow; on the other hand, when the reference mark III is moved below the infant's nose by rotating the bottle about its axis, the flow will be maximum because of the separation of the lips of the slit 3; when the reference mark II is below the infant's nose, the flow is near the average of the flows relating to the reference marks I and III.

When the infant stops sucking, air enters the holes 4a, 4b, 4c and cancels the partial vacuum that had been set up in the bottle. Moreover, the holes 4a, 4b, 4c prevent a change in the lengths of the arms of slit 3 when being in use.

The comparative tests discussed below shall elucidate the invention.

The tests were carried out by the procedure now to be discussed. The feeder is mounted on a bottle in turn set vertically on a support with the feeder at the bottom. The bottle bottom is open, so that excess air pressure of 4 kPa can be applied to the water it contains, this value corresponding to an infant's suction. To simulate the conditions of use, the nipple is squeezed along the squeezing axis AE within jaws 7 mm apart representing the infant's jaws: the quantity of water flowing in 30 seconds is measured and the flow is expressed in $cm^3$/min.

The reference marks I, II, and III are placed on the feeder in the manner previously described in relation to FIGS. 1 through 3.

Initially, the diametric plane of the feeder, which contains the reference mark I, passes through the feeder squeezing plane AE. Next, the jaws are made to rotate relative to the bottle by an angle θ in steps of 10° in the direction of the arrow f (FIG. 2) and the bottle flow is measured for the various angles θ. The curves of FIGS. 4 through 11 are thus obtained. Each curve point corresponds to the average of the measurements on five identical feeders, the measurement being repeated twice for each feeder.

Figure 4:
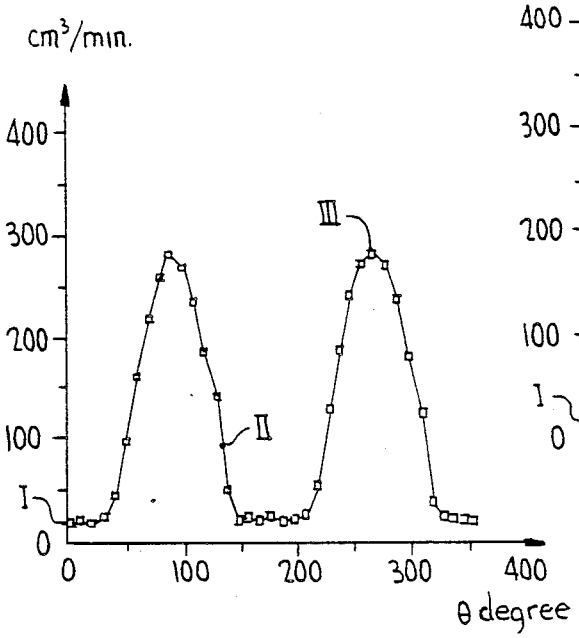

The curve shown in FIG. 4 is for a feeder with a straight 2.8 mm slit comprising a 0.20 mm diameter hole at each end. This curve is for comparison: it is an angular-slit feeder with Γ=180° and $l_1=l_2=1.4$ mm. This tested feeder is in the state of the art (French Patent No. 2,052,206). Near the reference mark I, the flow is practically flat while the angle θ increases. The flow value for θ=0 (reference mark I on AE) is 20 $cm^3$/min; at θ=135° (reference mark II on AE), it is 94.5 $cm^3$/min; and at θ=270° (reference mark III on AE), it is 281 $cm^3$/min. Accordingly, the flow at the reference mark II differs comparatively little from that of the flow at reference mark I, this is unsatisfactory.

Figure 5:
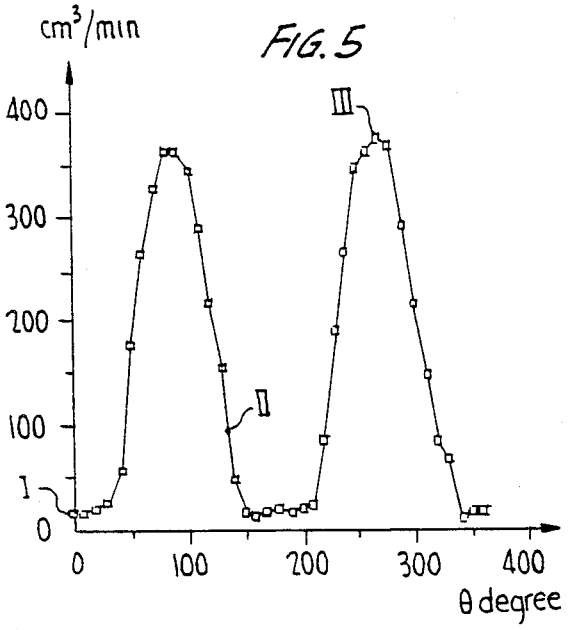

The curve shown in FIG. 5 represents a feeder with a straight slit 3.6 mm long and comprising three holes each 0.20 mm in diameter, one each at the end of the slit and one at the center. FIG. 5 also is shown for comparison: it is an angular-slit feeder with θ=180° and $l_1=l_2=1.8$ mm. The flow at θ=0 is 15 $cm^3$/min; at θ=135° it is 101.5 $cm^3$/min; and at θ=270°, it is 376 $cm^3$/min. While this curve is less flat near the reference mark I than that of FIG. 4, the flow at the reference mark II still is far from the arithmetic average of the flows at reference marks I and III. Consequently, employing a third hole at the center of the slit is no remedy for the drawbacks of the state of the art.

Figure 6:
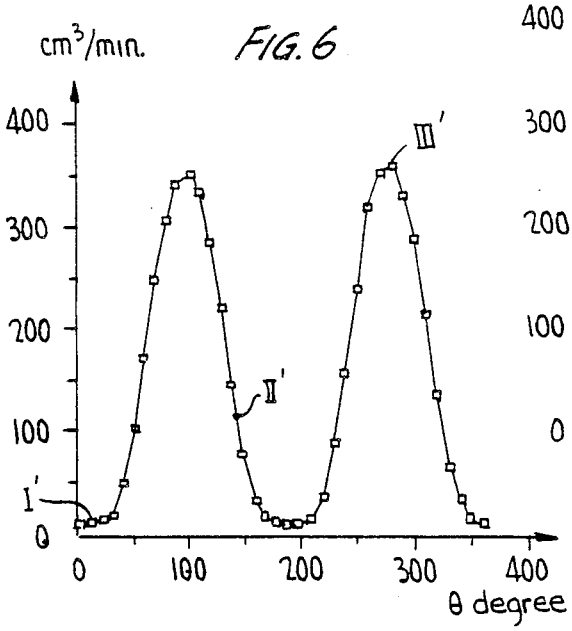

The curve of FIG. 6 shows the results for feeder with the angular slit of the invention where Γ=165°, and with three 0.20 mm diameter holes at the ends and at the center of the slit, $l_1=l_2=1.8$ mm. The positions θ=0 and θ=270° do not precisely match the minimum and maximum flows, but are shifted by about 10° from them. The position I' for the minimum is at θ=10°, and the position III' for the maximum is at lθ=280°. The intermediate position, called position II', therefore, is θ=145°.

In practice, obviously, the reference marks I, II, and III would be placed at the positions I', II', III'The flow at θ=10° is 12 $cm^3$/min; at θ=145° it is 185 $cm^3$/min; and at θ=280° it is 350 $cm^3$/min. The flow at the position II', therefore, is fairly near the average of the flows at positions I' and III'. On the other hand, if illustratively the bottle is offset from position I', for instance by rotating it in either direction by 10° to 20°, the flow increase fairly linearly: therefore, the flow can be significantly controlled by slightly changing the position of the bottle. Similarly, the bottle flow can be reduced linearly by shifting it in either direction from position III' or position II'.

Figure 7:
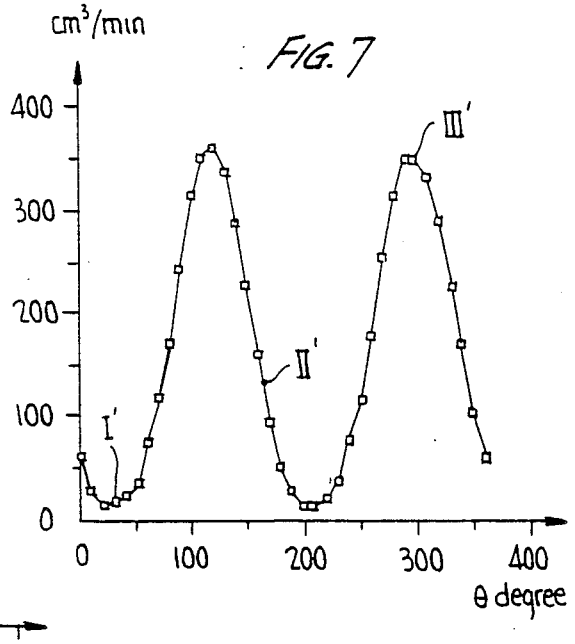

The curve of FIG. 7 shows a feeder with an angular slit of the invention where Γ=135°, $l_1=l_2=1.8$ mm, and with three holes as in the feeder of FIG. 6. Minimum and maximum values no longer are obtained when AE coincides with the reference marks, I, II, III, but they are achieved when shifted relative to said marks by 20°. The flow at position I' (θ=20°) is 16 $cm^3$/min; in position II' (θ=155°) it is 196 $cm^3$min, and in position III' (θ=290°) it is 351 $cm^3$/min. The flow in position II' is fairly close to the average of the flows for positions I' and III'. The curve again shows that the feeder flows may be made to vary linearly by rotating the bottle by less than 45° about the three positions I', II', III'.

Figure 8:
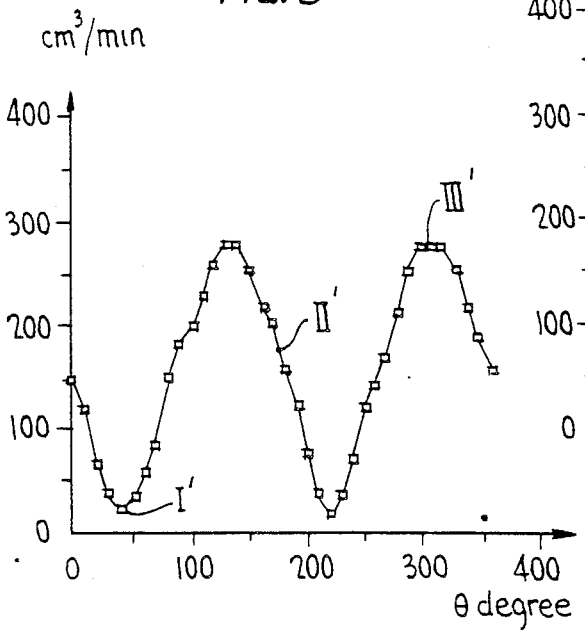

The curve of FIG. 8 represents a feeder with an angular slit of the invention where Γ=105°, $l_1=l_2=1.8$ mm and with three holes as in the test relating to FIG. 7. The minimum value (position I') and the maximum value (position III') of the flow are shifted by about 40° from the reference marks I and III. The flow.at position I' (θ=40°) is 22 $cm^3$/min; at position II' (θ=175°) it is 181 $cm^3$/min, and at position III' (θ=310°) it is 277 $cm^3$/min.

Curves 6 through 8, furthermore, show that the maximum flow in position III', all other conditions being kept constant, varies from 356 $cm^3$/min for Γ=165° to 277 $cm^3$/min at Γ=105°. The maximum flow decreases as Γ decreases.

Figure 11:
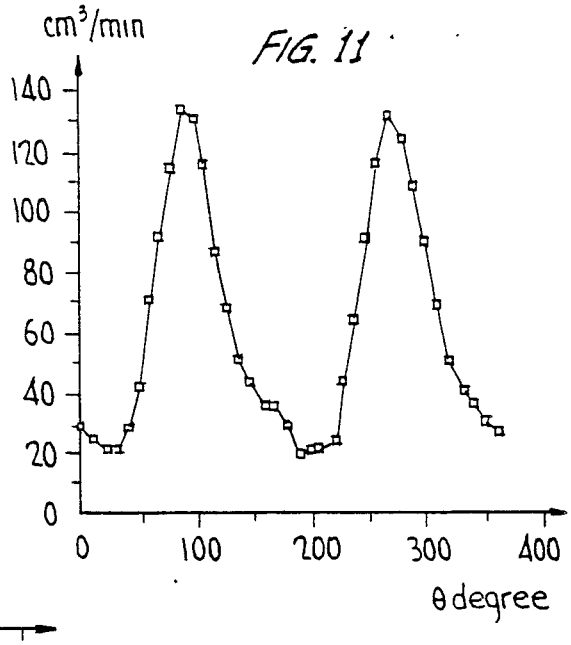

The curve of FIG. 11 shows a feeder with an angular slit for which Γ=105°, $l_1=1.8$ mm, and $l_2=0.4$ mm. The results are satisfactory.

Figure 9:
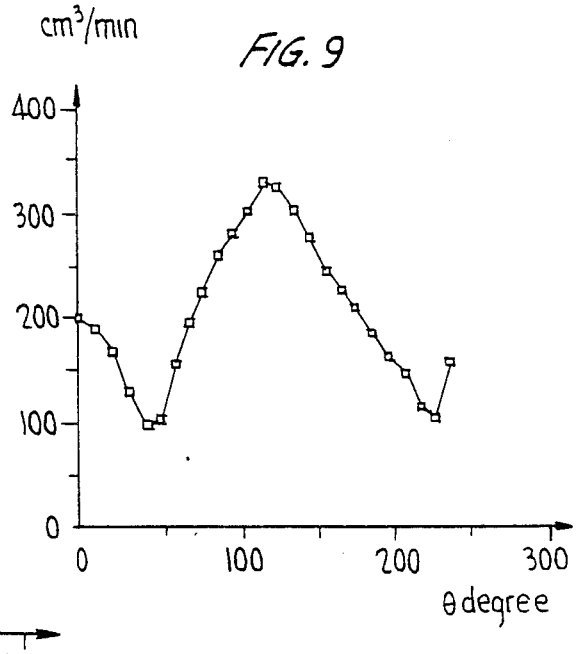

The curve of FIG. 9 is for a feeder outside the invention with a V-shaped slit for which F=90° and $l_1=l_2=1.8$ mm. The minimum flow is excessive and the difference between the minimum and maximum flows is too low.

Figure 10:
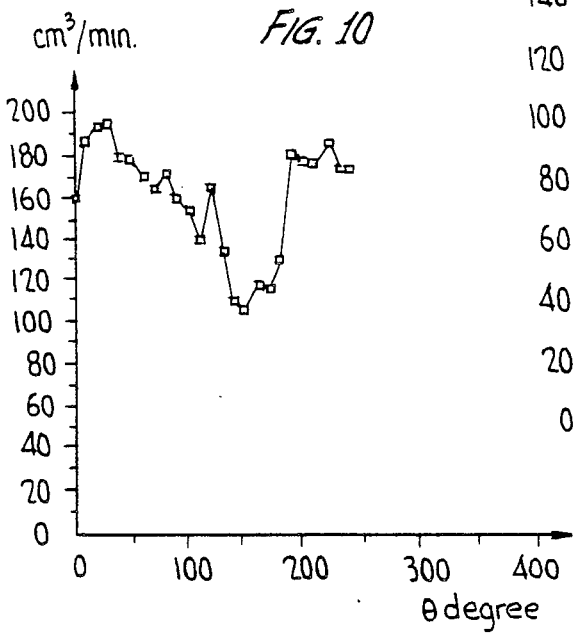

The curve of FIG. 10 is for a feeder outside the invention with a V-shaped slit for which $\Gamma=45$ and $l_1=l_2=1.8$ mm. This curve is irregular and lacks a clear maximum or minimum.

We claim:

1. A variable-flow feeder to be fitted on a bottle comprising a nipple with a slit formed in one end of said nipple, said slit having a first arm and a second arm which subtends an angle between said arms, wherein said angle is an obtuse $\Gamma$ between 165° and 95° of which said angle's vertex lies on said feeder's axis, said first arm of said slit having a length $l_1$ and said second arm of said slit having a length $l_2$ and $l_1$ being greater than $l_2$ and the ratio $l_1/l_2$ being between 1 and $\delta$ with the value of $\delta$ increasing from 1 to 10 with the value 1 being excluded when the value of said angle $\Gamma$ decreases from 165° to 95°, and said first and said second arms of said slit being lines cut in said feeder without the removal of material from said feeder and terminating at each of their non-adjacent ends into a first hole and a second hole, respectively, formed in said nipple.

2. A feeder as claimed in claim 1 wherein said slit further comprises a hole at the point said first arm meets said second arm.

3. A feeder as claimed in claim 1 or claim 2 wherein said first arm and said second arm are of a length between 0.4 mm and 4 mm.

4. A feeder as claimed in claim 1 or claim 2 wherein the diameter of said holes is between 0.15 mm and 0.25 mm.

5. A feeder as claimed in claim 1 or claim 2 wherein said end of said nipple is convex.

6. A feeder as claimed in claim 1 wherein said value of $\delta$ is between 1 and 4.5.

* * * * *